US005945958A

United States Patent [19]

Staufer et al.

[11] Patent Number: 5,945,958

[45] Date of Patent: Aug. 31, 1999

[54] LOOP ANTENNA

[75] Inventors: Hans Staufer, Surla Croix; Michel Burri, Gd-Saconnex, both of Switzerland

[73] Assignee: Motorola, Inc., Schaumburg, Ill.

[21] Appl. No.: 08/891,962

[22] Filed: Jul. 14, 1997

[30] Foreign Application Priority Data

Jul. 23, 1996 [GB] United Kingdom ..... 9615392

[51] Int. Cl.[6] ..... H01Q 7/00

[52] U.S. Cl. ..... 343/728; 343/742; 343/725; 343/842

[58] Field of Search ..... 343/742, 744, 343/748, 866, 867, 870, 737, 728, 725, 726, 842, 856

[56] References Cited

U.S. PATENT DOCUMENTS

| | | | |
|---|---|---|---|
| 2,235,163 | 3/1941 | Peterson | 343/737 |
| 3,631,499 | 12/1971 | Turner | 343/701 |
| 4,160,978 | 7/1979 | DuHamel | 343/742 |
| 4,433,336 | 2/1984 | Carr | 343/728 |
| 5,485,165 | 1/1996 | Foard | 343/741 |
| 5,734,353 | 3/1998 | Van Voorhies | 343/742 |
| 5,751,252 | 5/1998 | Phillips | 343/726 |

*Primary Examiner*—Robert H. Kim
*Assistant Examiner*—Layla Lauchman
*Attorney, Agent, or Firm*—Robert F. Hightower

[57] ABSTRACT

An improved loop antenna (10) comprises first (12) and second (16) conductive loops. Each of the first and second conductive loops has a discontinuity (14, 18). The first and second conductive loops (12, 16) are arranged substantially concentrically to form a capacitive coupling such that the tuned frequency of the loop antenna (10) has improved protection from external capacitance effects.

2 Claims, 1 Drawing Sheet

—PRIOR ART—

—PRIOR ART—

LOOP ANTENNA

FIELD OF THE INVENTION

This invention relates to loop antennae, and particularly but not exclusively to H-field loop antennae having a tuned frequency.

BACKGROUND OF THE INVENTION

Short range radio data transmission systems often use E-H field type tuned loop antennae. Such loop antennae are usually very small in size and have to fit into very small spaces (e.g. remote car alarm keys).

A normal H-field loop antenna consists of a metallic loop conductor and a tuning capacitor at its ends. The form of the loop itself is of secondary importance and known loops have different physical shapes such as rectangular or diamond etc. The tuning capacitance is typically placed in the centre of the loop but can equally be displaced from it.

The use of a tuning capacitor with an H-field loop antenna has a series of significant drawbacks. For example, in an environment where hand held equipment is used, such as a remote car alarm key, human body capacitance can significantly de-tune the resonant frequency of the loop antenna at the capacitance intersection.

Furthermore the requirement for a discrete capacitor component adds to the cost of the loop antenna and the complexity of the design.

This invention seeks to provide a loop antenna which mitigates the above mentioned disadvantages.

SUMMARY OF THE INVENTION

According to the present invention there is provided a loop antenna comprising first and second conductive loops, each of the first and second conductive loops having a discontinuity, wherein the first and second conductive loops are arranged substantially concentrically to form a capacitive coupling such that the tuned frequency of the loop antenna has improved protection from external capacitance effects.

Preferably the first and second conductive loops are substantially circular in shape. Preferably the discontinuities of the first and second conductive loops are substantially diametrically opposed.

In this way a loop antenna is provided, which is less susceptible to capacitive effects of external structures, such as the human body.

BRIEF DESCRIPTION OF THE DRAWINGS

An exemplary embodiment of the invention will now be described with reference to the drawing in which.

DETAILED DESCRIPTION OF A PREFERRED EMBODIMENT

Figure 1:
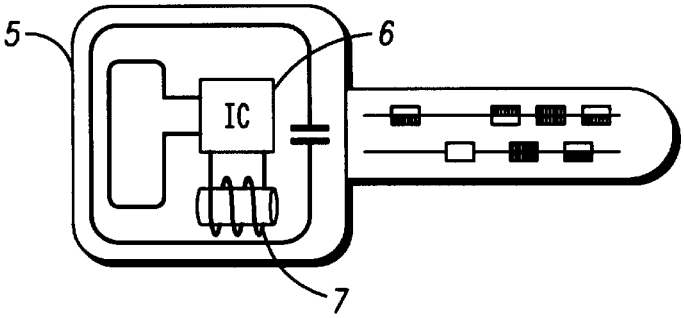
FIG. 1 shows a prior art remote car alarm key, incorporating a loop antenna.

Referring to FIG. 1, there is shown a remote car alarm key 5, comprising a loop antenna 7 and an integrated circuit 6.

Figure 2:
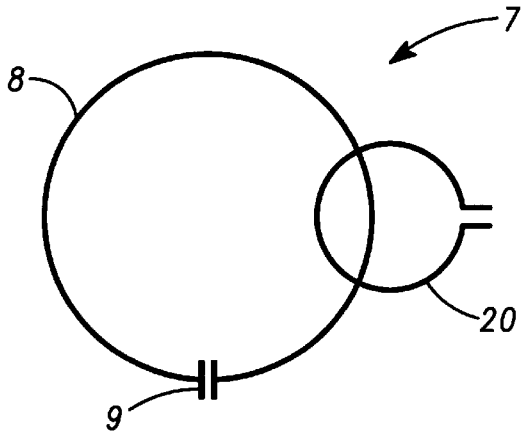
FIG. 2 shows a prior art loop antenna.

Referring now also to FIG. 2, there is shown a prior art loop antenna 7, as used in the remote car alarm key 5. The loop antenna 7 includes a metallic loop conductor 8 having a capacitor 9 coupled between two ends of the loop conductor 8, and a coupling antenna 20, which is formed by a further loop.

In operation, the prior art loop antenna 7 operates at a tuned frequency given by the characteristics of the capacitor 9 and the loop conductor 8. The coupling antenna 20 provides coupling to external circuitry, such as the integrated circuit 6 of the remote car alarm key 5.

Figure 3:
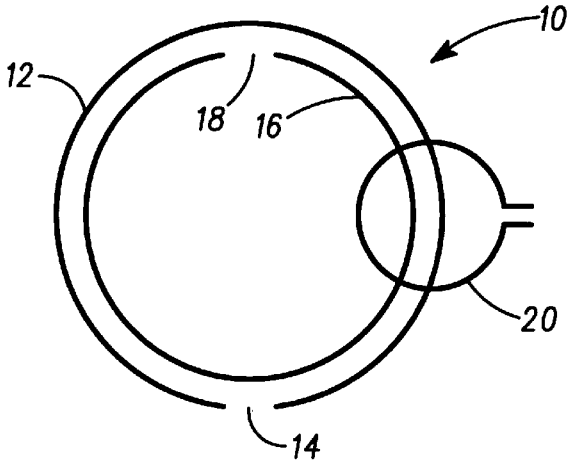
FIG. 3 shows preferred embodiment of an improved loop antenna in accordance with the invention.

Referring now to FIG. 3, there is shown an improved loop antenna 10 comprising first 12 and second 16 conductive loops, arranged concentrically. The first loop 12 has a discontinuity 14, and the second loop has a discontinuity 18, such that the ends of the first and second loops 12, 16 are open.

In the preferred embodiment, the first and second loops are substantially circular, although it will be appreciated that other shapes and configurations are possible. For example, rectangular or diamond shaped loops could be used.

The first and second loops 12 and 16 are arranged such that the discontinuities 14 and 18 are on opposite sides of the loops, i.e. diametrically opposed. The size and relative position of the discontinuities 14 and 18, and the size and dielectric spacing of the first and second loops 12 and 16 determine a particular tuned frequency, which is the tuned frequency of the improved loop antenna 10.

In this way the tuning capacitance is distributed over the whole surface of the first and second loops 12 and 16 and as a result the improved loop antenna 10 is less affected by external capacitive effects, such as the close proximity of a human body.

The improved loop antenna is coupled to a coupling antenna 20 in the same manner as the prior art, and in this way coupling is provided to external circuitry, such as the integrated circuit 6 of the remote car alarm key 5.

It will be appreciated that alternative embodiments to the one described above are possible. For example, the discontinuities 14 and 18 need not be diametrically opposed, but could be in an alternative configuration.

We claim:

1. A loop antenna comprising first and second conductive loops, each of the first and-second conductive loops having a substantially circular shape and also having a discontinuity wherein the discontinuities of the first and second conductive loops are substantially diametrically opposed, and wherein the first and second conductive loops are arranged substantially concentrically to form a capacitive coupling such that the tuned frequency of the loop antenna has improved protection from external capacitive effects.

2. A loop antenna comprising:

First and second conductive loops each having an electrical discontinuity wherein the first and second conductive loops are arranged substantially concentrically to form a capacitive coupling and wherein the first and second conductive loops are not electrically connected together such that the tuned frequency of the loop antenna has improved protection from external capacitive effects.

* * * * *